United States Patent [19]

Bodig et al.

[11] 4,117,818

[45] Oct. 3, 1978

[54] IGNITION SYSTEM FOR INTERNAL COMBUSTION ENGINES WITH TAPPED IGNITION COIL

[75] Inventors: Bernd Bodig, Leinfelden; Helmut Schmied, Schwaikheim; Gerd Hohne, Ludwigsburg, all of Germany

[73] Assignee: Robert Bosch GmbH, Stuttgart, Germany

[21] Appl. No.: 704,116

[22] Filed: Jul. 9, 1976

[30] Foreign Application Priority Data

Jul. 12, 1975 [DE] Fed. Rep. of Germany ..... 2531337

[51] Int. Cl.[2] ..... F02P 3/02

[52] U.S. Cl. ..... 123/148 E

[58] Field of Search ..... 123/148 E, 117 R; 315/209 T, 209 SC, 209 R, 180

[56] References Cited

U.S. PATENT DOCUMENTS

| | | | |
|---|---|---|---|
| 3,291,110 | 12/1966 | Peters | 123/148 E |
| 3,293,492 | 12/1966 | Wald | 315/180 |
| 3,877,453 | 4/1975 | Brungsberg | 123/148 E |
| 3,892,219 | 7/1975 | Preiser et al. | 123/148 E |

*Primary Examiner*—Samuel Feinberg
*Attorney, Agent, or Firm*—Flynn & Frishauf

[57] ABSTRACT

The primary of the ignition coil is tapped to provide two partial primary portions which are serially connected; during an initial current flow, only one partial portion has current flowing therethrough, the other partial portion being short-circuited. When the current through the coil has risen to a predetermined level, as sensed by current flow through a sensing resistor, the short circuit across the second partial portion is removed so that current can continue to flow through the entire primary, causing a substantial drop in current level but maintaining the stored inductive energy. Current can thus rise rapidly initially, so that the coil will store sufficient energy to initiate sparking at high speeds of the connected internal combustion engine while, at low speeds thereof, the overall current flow through the coil is decreased.

18 Claims, 3 Drawing Figures

IGNITION SYSTEM FOR INTERNAL COMBUSTION ENGINES WITH TAPPED IGNITION COIL

The present invention relates to an ignition system for internal combustion engines having an ignition coil with a tapped primary winding.

Ignition systems using ignition coils have the advantage that they are, generally, simple and provide reliable ignition energy. They are thus preferred for many applications. Such ignition systems do, however, have the disadvantage that the primary winding has current supplied thereto at low engine speeds for a period of time which is much longer than that necessary to store sufficient energy for an effective spark at the spark plug. This causes unnecessary current consumption.

It is an object of the present invention to provide an ignition system in which the supply of current to the ignition coil, and hence the storage of energy therein, is more properly matched to the energy requirements of the spark plug and varying speeds of the internal combustion engine.

Subject matter of the present invention

Briefly, the primary winding of the ignition coil is tapped to provide a first partial primary and a second partial primary. Only one partial primary has current supplied thereto in pulses, during repetitively recurring time intervals. The second partial primary, which has a larger number of turns, is switched to carry the induction current of the first partial primary during gaps in energization of the first partial primary.

In accordance with a feature of the invention, control circuits are provided to control the respective current flow through the relspective primary portions, so that the supply circuit for the coil includes a controlled switch connected in circuit with the first partial primary to energize the first partial primary when the switch is closed, during successive repetitively recurring time intervals, the shunt circuit being connected to the second partial primary and carrying the induction current arising in the first primary winding becoming effective at the ends of the respective current carrying time intervals.

Figure 1:
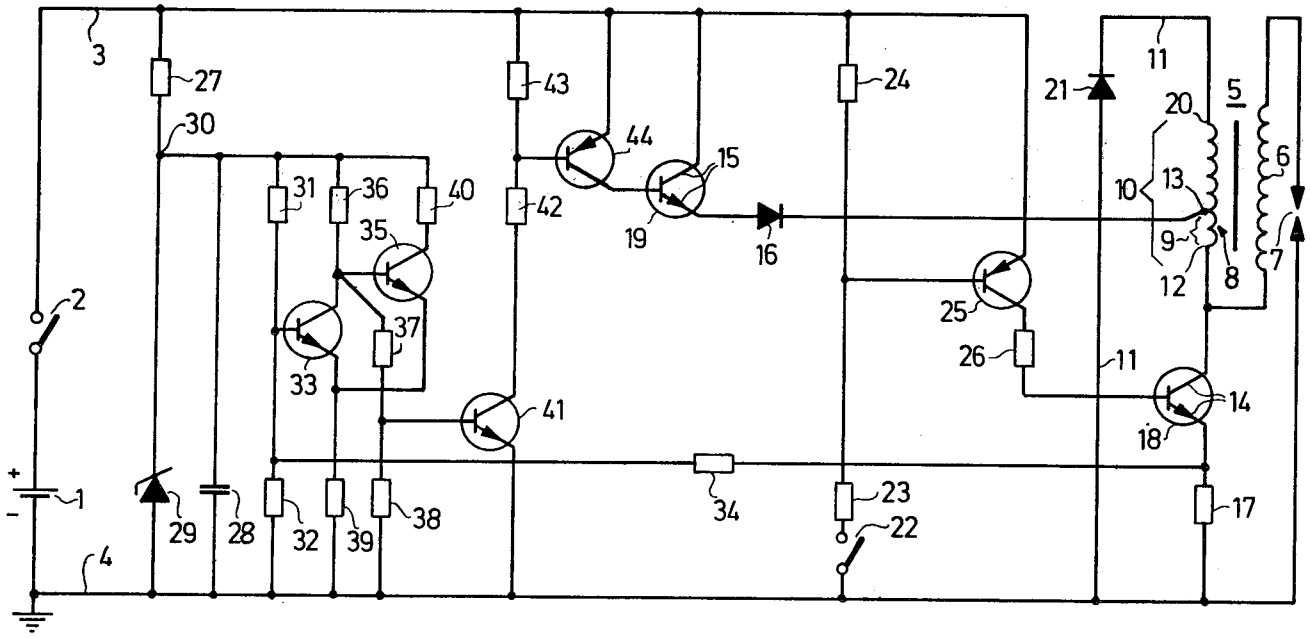
Figure 2:
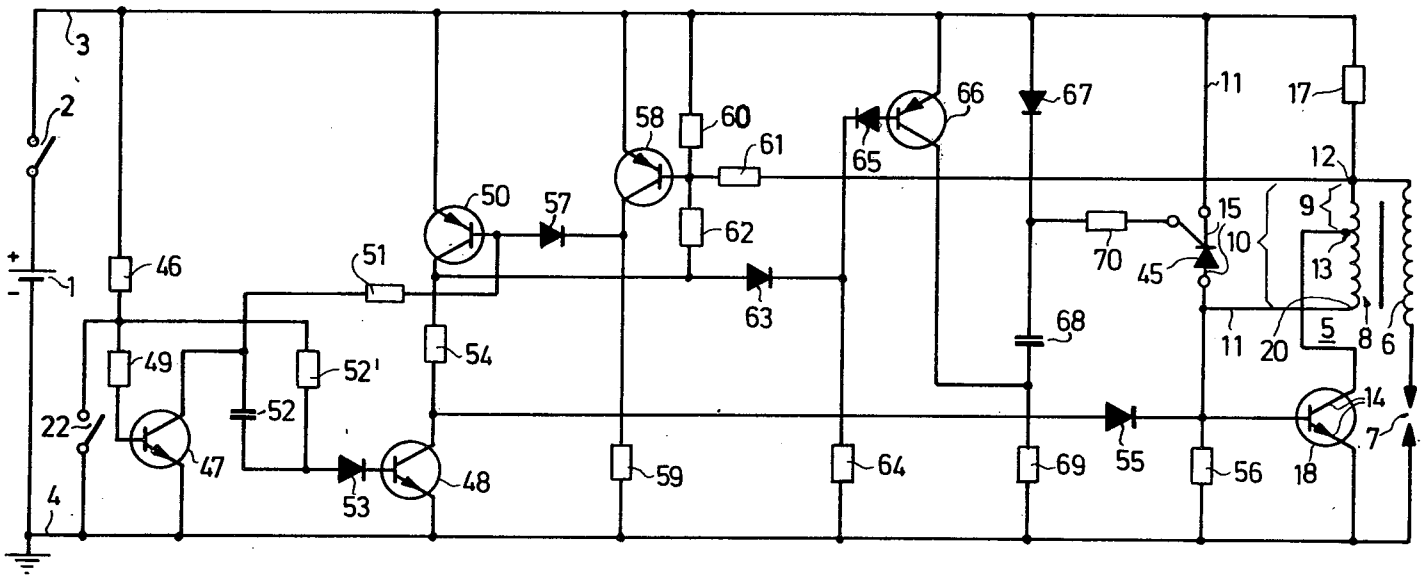
Figure 3:
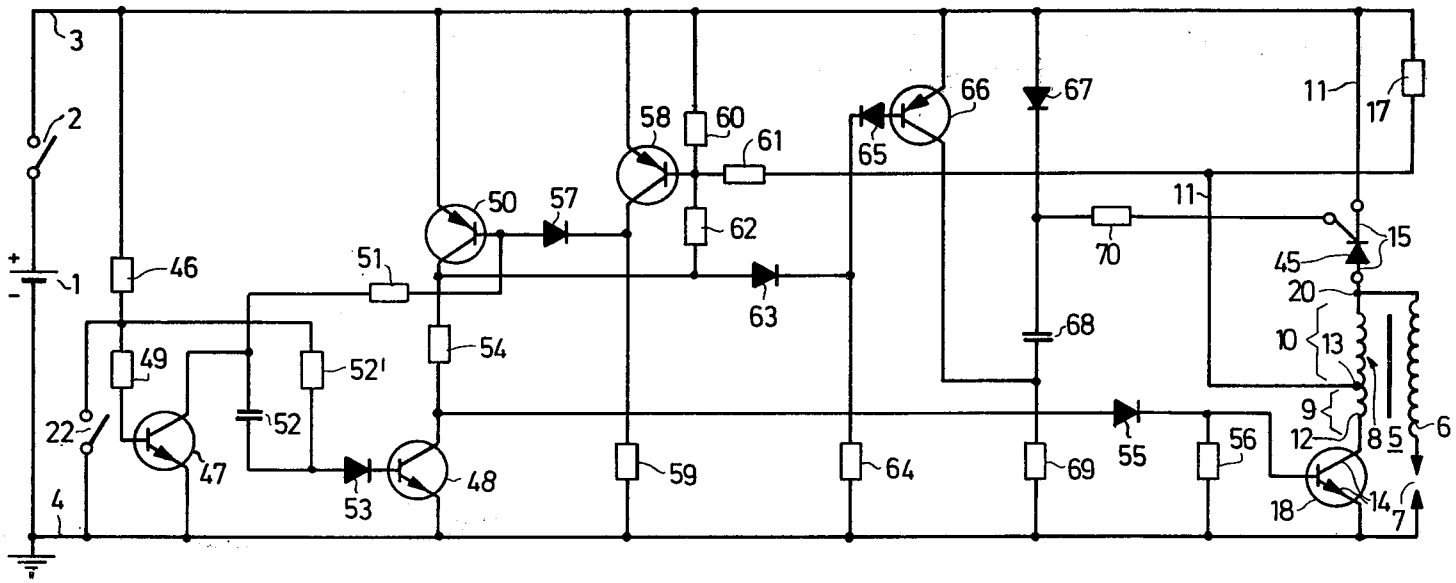

The invention will be described by way of example with reference to the accompanying drawings, wherein:

FIG. 1 is a general schematic circuit diagram of an ignition system in accordance with the present invention; and FIGS. 2 and 3 shows modifications of the system, in block diagram form.

An internal combustion engine, not shown, has the ignition system of FIG. 1 connected thereto. This system is particularly suitable for automative internal combustion engines. A direct current supply 1 which, for example, may be formed by the vehicle battery, supplies power through an ignition switch 2 to a positive supply bus 3 and a negative or ground or chassis bus 4. An ignition coil 5 stores ignition energy which is supplied over secondary 6 to spark plug 7. Spark plug 7 is connected to ground or chassis bus 4. Secondary 6 can be connected to a plurality of spark plugs through a distributor, as well known.

The primary winding 8 of ignition coil 5 has a first partial portion 9 to store energy by having current flow directed therethrough from source 1 during recurring sequential time or pulse periods; a larger range of windings 10, which may include both the first partial primary portion and a second portion connected between terminals 13 and 20, is connected in circuit with to the first primary portion 9. The circuit connecting the two portions is schematically a shunt circuit 11, which includes the winding portion 10, carrying current at the termination of the current pulses supplied to the fist partial portion 9, that is, during the gaps of pulses. The partial portion 9 is connected between a first terminal 12 of the primary 8 and a tap point 13. A serially connected switch 14, formed as a transistor 18, connects the partial primary portion 9 to negative or chassis bus 4. The supply line from positive bus 3 is connected through an auxiliary switch 15, formed by a transistor 19, and over a blocking diode 16, to prevent reverse polarity pulses from being applied over switch 15 to the tap point 13, then to continue to the second terminal 12 of the first partial primary 9. The main circuit is completed over switch 14. Switch 14 is serially connected to a sensing or monitoring resistor 17 and hence to the second or chassis bus 4.

The connecting switch 14 is formed by the emitter-collector path of npn transistor 18, which is so connected that its emitter forms a junction with resistor 17. The auxiliary switch 15 is formed by the emitter-collector path of an npn transistor 19, connected with its collector to the positive bus 3.

Primary 8 of coil 5 continues from its tap point 13 to the second terminal 20. The shunt circuit 11, starting from the terminal 12 of the first primary portion, includes switch 14, monitoring or sensing resistor 17, diode 21 providing protection against back-currents, and return to the second terminal 20 of the primary 8.

Storage of ignition energy depends on the current passing state of a controlled switch 22. Controlled switch 22 is schematically indicated as a blade-type switch; it may be formed, however, by a customary cam-conrolled breaker switch usually part of the distributor structure of an automative distributor, or as any other switch, for example of types which replace the breaker assembly and form non-contacting switching; it may be the emitter-collector path of a transistor, not shown, which in turn is controlled by a mechanical switch or, similar to an a-c generator, by a signal transducer, directly, or over one or more flip-flop circuits in a non-contacting ignition control system.

Controlled swtich 22 is connected in series with two resistors 23, 24, resistor 24 connecting to positive bus 3. The common junction of the two resistors 23, 24 is connected to the base of a pnp transistor 25, the emitter of which is connected to bus 3. The collector of transistor 25 is connected through resistor 26 to the base of transistor 18 forming switch 14. A resistor 27 is connected to positive bus 3 and further to a parallel circuit formed of a capacitor 28 and a Zener diode 29, connected in blocking direction with respect to current source 1. The junction 30 thus provides a source of stabilized voltage.

Junction 30 is connected through the series connection of two resistors 31, 32, forming a voltage divider, to the second chassis bus 4. The junction of the two resistors 31, 32 is connected to the base of an npn transistor 33 and, further, through a reisistor 34 to the emitter of the transistor 18 forming switch 14. Transistor 33 has its collector connected to the base of an npn transistor 33 and further through a resistor 36 to the stabilized junction 30. Additionally, its collector is connected through resistors 37, 38, forming a voltage divider, to chassis bus 4. The emitter of transistor 33, as well as the emitter of transistor 35, are connected through resistor 39 to chassis bus 4. The collector of transistor 35 is connected through resistor 40 to the stabilized junction 30. The common connection of the resistos 37, 38 is connected to the base of an npn transistor 41, the emitter of which is connected to chassis bus 4, and the collector through two series resistors 42, 43 to positive bus 3. The junction of resistos 42, 43 is connected to the base of a pnp transistor 44, the emitter of which is connected to the positive bus 3 and the collector to the base of transistor 19 forming switch 15.

Operation: The system is energized by closing of ignition switch 2. The control switch 22 is closed, for example by enggement of the cam land with a breaker switch, to render switch 22 conductive; or by suitably controlling a semiconductor switch. Control current will flow over the emitter-base path of transistor 25 and resistor 23, thus causing the emitter-collector path of trnsistor 25 to be conductive and to permit control current to flow over resistor 26 to the base of transistor 18 so that switch 14, formed by the emitter-collector path of transistor 18, will become conductive. The emitter-collector path of transistor 33 will be blocked at this time; the emitter-collector path of transistor 35, hence, will be conductive. Resistors 27, 36, 37 and the base-emitter path of transistor 41 will thus have current flow therethrough so that transistor 41 is conductive and current can flow over the emitter-base junction of transistor 44 which propagates over resistor 42 and the emitter-collector path of transistor 41 to continue to flow to the chassis bus 4. This causes transistor 44 to become conductive and supply current through its emitter-collector path to the base of trnsistor 19. The emitter-collector path of auxiliary switch 15 formed by transistor 19 will thus become conductive and current will flow through diode 16, the first primary portion 9 of primary 8, switch 14, and through sensing resistor 17. This current will rise rapidly due to the relatively low inductivity and resistance of the partial winding portion 9, thus ensuring rapid storing of sufficient energy to effect sparking of spark plug 7. When the current has reached a value which corresponds to the required energy to be stored, the voltage across sensing resistor 17 will cause current to flow over resistor 34 to the base-emitter of transistor 33 and resistor 39. Transistor 33 will now become conductive, causing turn-off of transistor 35. The emitter-collector path of transistor 41, as a consequence, will then also block, causing the emitter-collector path of transistor 44 to block and, in turn, to turn off the auxiliary switch 15 formed by the emitter-collector path of transistor 19.

When the auxiliary switch 15 formed by the transistor 19 opens, current flow through the partial primary 9 is interrupted. Interruption of the current flow causes an inductive voltage to occur which, however, can cause the current to flow through the connecting switch 14, the sensing resistor 17, diode 21, and through the winding portion 20 between the terminal 20 and the tap point 13 as well as the portion between tap 13 and bottom terminal 12. Due to the relatively high inductance of both winding portion energy, will decay only slowly. At the ignition instant switch 22 will open causing switch 14 to open thus breaking current flow through coil 5.

Upon engine starting, that is, at low speeds, the ignition voltage should be high to ensure reliable ignition of the compressed fuel-air mixture. At high engine speeds, reliable ignition is effected even with much lesser sparking voltages, so that a lesser arc-over voltage at the spark plug suffices when the engine turns rapidly.

Embodiment of FIG. 2: The positive bus 3 is connected through sensing resistor 17 to the first terminal 12 of the ignition coil 5. Current then can continue to flow through the partial primary portion 9, tap 13, and main switch 14 to the chassis bus 4. The chunt branch 11 extends from the second terminal 20 of the primary 8 to be connected over auxiliary switch 15, and then through the sensing resistor 17 to the first terminal 12 of the primary 8. The auxiliary switch 15 is formed by the anode-cathode path of a thyristor 45.

Ignition energy is stored in the ignition coil 5 when the switch 22 is closed, that is, is changed to the current-supply condition. Switch 22 is connected through resistor 46 to positive bus 3. A monostable multivibrator (MMV) is connected to switch 22. The MMV has an npn transistor 47 and an npn transistor 48, both of which transistor 47, 48 have their emitters connected to negative bus 4. The base of transistor 47 is connected through resistor 49 to the junction of switch 22 and resistor 46. The collector of transistor 47 is connected to a capacitor 52 and then through a diode 53 to the base of transistor 48. The collector of transistor 47 is further connected through resistor 51 to the base of a further transistor 50. The anode of diode 53 is additionally connected over a resistor 52' to the junction of the two resistors 46, 49 and hence to switch 22. Transistor 48 has its collector connected to a resistor 54 and then to the collector of the transistor 50, the emitter of which is connected to positive bus 3. The collector of transistor 48 is further connected through a blocking diode 55 to the base of the transistor 18 forming the main switch 14. The base of the transistor 50 is connected to the anode of a diode 57, the cathode of which is connected to the collector of a transistor 58, as well as to a resistor 59, the other terminal of which is connected to chassis bus 4. The transistor 58 has its emitter connected to positive supply bus 3. Its base is connected through a junction from which three resistors radiate — resistor 60 is connected to positive bus 3, resistor 61 is connected to the terminal of sensing resistor 17 remote from the connection to positive bus 3, and hence to the terminal 12 of the primary 8 of coil 5; resistor 62, operating as a positive feedback coupling resistor, is connected to the collector of transistor 50. The resistor 61, and hence the collector of transistor 50, is additionally connected to the anode of a blocking diode 63, the cathode of which is connected to the cathode of a further blocking diode 65, the anode of which is connected to the base of transistor 66, in order to control the conduction state of transistor 66.

The positive bus 3 is further connected to a diode 67, poled in conductive direction and connected through a resistor 70 to the gate electrode of thyristor 45. The diode 67 is additionally connected to a capacitor 68 and through a resistor 69 to chassis bus 4. The junction of capacitor 68 and resistor 69 is also connected to the collector of transistor 66.

Operation of circuit of FIG. 2: The system is rendered operative by closing ignition switch 2. When the breaker control switch 22 closes, current can be supplied through resistor 46 directly to the negative bus 4; this causes collapse of the voltage across resistor 49 and the base-emitter junction of transistor 47, and transistor 47 will block causing, likewise, blocking of transistor 48. Transistor 58 is in blocked state, so that the emitter-base path of transistor 50 can have current flowing therethrough which will propagate through blocking diode 57 and resistor 59 to the nagative bus 4. The emitter-collector path of transistor 50, resistor 54 and blocking diode 55 as well as the base-emitter path of transistor 18 will thus have current flowing therethrough, causing main switch 14 to be in closed state. The current flowing from source 1 through sensing resistor 17 and the partial primary 9 will rise rapidly until it reaches a predetermined value, at which time sufficient ignition energy will be stored in coil 5. At this current value, a voltage drop will occur across the sensing resistor 17 of such magnitude that transistor 58, coupled to the resistor 17 through resistor 61, will change to conductive state. Upon conduction of transistor 58, transistor 50 will change to blocked state. The switch-over is accelerated by the feedback resistor 62. The emitter-collector path of transistor 18 forming switch 14 will rapidly change to blocking state since the controlled current to its base will have collapsed. The collector of transistor 18, as well as the anode of the thyristor 45 will now have the induction voltage of the primary winding 8 appear thereat. The emitter-collector path of transistor 50 is non-conductive and current can thus flow over the emitter-base junction of transistor 66, diode 65 and resistor 64, changing the emitter-collector path of transistor 66 into conductive state. The control capacitor 68 which previously had been charged over diode 67 and resistor 69 can now discharge over resistor 70 and the gate electrode of thyristor 45, as well as through the emitter-collector path of transistor 66. The anode-cathode path of thyristor 45 thus changes to current-carrying state. The induction voltage cannot rise any more since the induction current flowing through switch 15, the sensing resistor 17 and the primary portion 10 will have commenced. Due to losses in the circuit, this current will gradually decrease until it has reached a value at which the ignition energy is still sufficient to cause ignition of the spark plug without, however, being excessive with respect to required ignition energy. At that time and at that stored energy, the current at the sensing resistor 17 will have caused a lower voltage drop, which lower voltage drop will control the transistor 58 to switch over to blocking state, causing transistor 50 to rapidly change over to become conductive. Upon conduction of transistor 50, the connecting switch 14 formed by transistor 18 will again change to closed circuit state so that current will flow through the partial primary portion 9, supplied from source 1. Thyristor 45 will no longer have positive voltage at the anode thereof, causing effectively, open circuiting of the thyristor 45. Current in the partial primary portion 9 will again rise until the current through sensing resistor 17 causes a voltage drop sufficient to again change over transistor 58 so that the cycle will repeat as above described. This cyclic repetition will continue for the duration that the ignition breaker switch 22 is in closed, current-passing state.

Breaker switch 22 will open at the ignition instant. Upon opening of switch 22, the emitter-collector path of transistor 47 and, as a consequence, the emitter-collector path of transistor 50 will change to current-carrying state. Since capacitor 52 must now change charge state, and this does not occur instantaneously, the emitter-collector path of transistor 48 remains non-conductive for a short time thereafter; typically, a period of about 50 $\mu$ seconds is suitable. This ensures that the disconnecting switch 14 remains current-carrying for a short period of time so that, if the anode-cathode path of thyristor 45 should, per chance, be conductive, the anode-cathode path of thyristor 45 will first open due to opening of thyristor 45 to non-conductive state. The emitter-collector path of transistor 50 is now current-carrying, and thus the emitter-collector path of transistor 66 remains in blocked state, so that the thyristor 45 cannot be controlled to become conductive. When the emitter-collector path of transistor 48 changes to current-carrying, the emitter-collector path of transistor 18 forming switch 14 becomes blocked, thus blocking the transistor 18 and effecting open of switch 14. This interrupts current flow through the partial primary portion 9, and a high-voltage pulse will be transduced to secondary winding 6 which causes arc-over at the spark plug 9.

Embodiment of FIG. 3; The basic difference between the embodiments of FIGS. 2 and 3 is that the supply line 3 is connected through the sensing resistor 17 to the tap point 13 of the ignition coil 5, so that current is connected through coil 5 and switch 14 to the second or chassis bus 4. The shunt circuit extends from the cathode of thyristor 45 through sensing resistor 17 to tap 13, and then from terminal 20 to the anode of thyristor 45. The portion of the ignition coil 5 between the tap 13 and the second terminal 20, and forming the winding portion 10, is selected to be greater of have more turns than the partial primary portion 9. All elements operating similarly to those previously described have been given the same reference numerals.

In contrast to FIG. 2, the induction current is carried only over that portion of the winding of the primary which is connected between the tap point 13 and the second end terminal 20.

The ignition energy which is stored for any one ignition event occurs only in sequential time intervals by current supply of the portion of the primary winding with current from source 1. The overall current requirements and current flow, therefore, averaged over time, are thus low.

Various changes and modifications may be made and features described in connection with any one of the embodiments may be used with any one of the others, within the scope of the inventive concept.

We claim:

1. Ignition system for an internal combustion engine to generate an ignition event having means (3,4) forming a current supply; and comprising an ignition coil (5) with a tapped primary (8) which forms a first primary partial portion (9) and a second primary portion (10), the second primary portion having an inductance which is high with respect to the inductance of said first primary partial portion (9);

a supply circuit connected to said current supply, including a controlled switch (14), connected in circuit with said first primary portion (9) only to energize only said first portion when the controlled switch (14) is closed;

control means connected to and controlling said supply circuit during succesive time intervals as a function of electromagnetic energy stored in the coil to become conductive and control current flow from said current supply through said first partial primary portion to store electromagnetic energy in the coil (5);

and a shunt circuit (11) connected to said second primary portion (10) and carrying the inductive current in the primary winding arising after the end of and during the periods between the respective time intervals.

2. System according to claim 1, wherein the primary partial portion (9) of the primary winding (8) has a first winding terminal (12) and a tap point connection (13) of the primary coil (8);

the controlled switch (14) being serially connected between said primary partial portion (9) and the current supply (3, 4) supplying direct current to the partial primary portion (9) through said controlled switch;

the primary winding (8) continues from said tap point (13) to a second and terminal (20) of the primary winding (8);

said second end terminal forming one of the two connection teerminals for the shunt circuit to the primary winding (8).

3. System according to claim 1, further comprising a second controlled switch forming an auxiliary switch and included in the supply circuit to control current flow from the current supply to the first primary partial portion (9), when closed, and flow of induction current in said shunt current (11), when open.

4. System according to claim 3, wherein (FIG. 1) the current (3, 4) is connected through said second controlled switch and then to the primary partial portion (9) of the primary winding (8), and said controlled switch (14) is further serially connected between the primary partial portion (9) and the supply.

5. System according to claim 3, wherein the shunt circuit (11) extends from one end terminal (12) of the primary winding through the controlled switch (14), and a diode (21) is provided, connected in said shunt circuit and poled in conductive direction with respect to the induction current, said diode being connected to the second end terminal (20) of the primary winding (8).

6. System according to claim 3, further comprising an isolating diode (16) located in the circuit connection between the auxiliary switch (15) and the primary partial portion (9) and poled to pass current supplied from a current supply source.

7. System according to claim 1, wherein said control means includes an ignition control switching means (22) which controls said controlled switch (14) and hence storage of energy in the ignition coil (5), energy storage being dependent on the switching state of said control switching means (22).

8. System according to claim 4, wherein said control means includes an ignition control switching means which controls storage of energy in the ignition coil (5) by controlling said controlled switch (14) to be closed when said control switching means is in energy storing state, said controlled switch (14) being closed and permitting induced current to pass and permitting current to flow duringthe time intervals during which current is supplied to said primary partial portion (9) of the primary winding from said current supply.

9. System according to claim 3, wherein said control means Includes (FIS. 2,3) an ignition control switching means (22) which controls storage of energy in the ignition coil (5), the control means (50, 58) connected to said controlled switch controlling said controlled switch (14) to be alternately conductive with respect to said auxiliary switch (15), the control means controlling the controlled switch (14) to be closed during the time intervals storing energy and passing current from the current supply, and the auxiliary switch (15) being closed in the intervals between closing of the controlled switch (14) and permitting flow of induced current.

10. System according to claim 9, wherein the current supply includes main supply line (3) extending from a source (1) to one end terminal (12) of the primary winding (8), and a return supply line (4) extending from the tap point (13) defining the primary partial winding (9) and connected through said controlled switch (14) (FIG. 2).

11. System according to claim 10, wherein the shunt circuit (11) extends from the second end terminal (20) of the primary winding (8) over said auxiliary switch (15) and back to the first end terminal (12) of the primary winding (8).

12. System according to claim 9, wherein the current supply includes main supply line (3) connected to the tap point (13) on the primary (8) of the coil (5) and defining the primary partial winding (9), the supply circuit continuing to the first end terminal (12) of the primary (8) and through the controlled switch (14) to the return supply line (4) (FIG. 3).

13. System according to claim 12, wherein the shunt circuit extends from the second end terminal (20) over the primary winding through the auxiliary switch (15) to the tap point (13) on the primary winding.

14. System according to claim 1, further comprising energy storage sensing means (17) connected to control current flow through said primary partial portion (9) and sensing when the current thereethrough has reached a predetermined level and providing a sensed output signal representative of said level;

and an evaluation circuit (33, 35, 41, 44, 61, 58, 50) responsive to the level of said sensing signal and controlling, respectively, energization of the supply circuit for said first partial portion (9) or closing of the shunt circuit (11) respectively to alternately supply electrical energy when the sensed signal is below a predetermined level, and to disconnect energy supply and permit stored energy to circulate in the shunt circuit when the signal has exceeded said predetermined level.

15. System according to claim 14, further comprising an auxiliary switch (FIG. 1 : 15) connected in series with a current supply source and the primary partial portion (9), said auxiliary switch being controlled by said evaluation circuit and inteerrupting continuity of the supply circuit and hence supply of energy to the primary partial portion when said sensing signal exceeds said predetermined level.

16. System according to claim 14, wherein said evaluation circuit is connected to and controls said control means (50, 58) to additionally control said controlled switch (14) to open when the sensing signal exceeds said predetermined level.

17. System according to claim 1, wherein (FIGS. 2, 3) said shunt circuit includes a controlled switch (15), the control means being additionally connected to said controlled switch (14) and, alternatingly, controlling continuity of said supply circuit and said shunt circuit by respectively alternatingly controlling said controlled switch (14) and said shunt circuit controlled switch (15).

18. System according to claim 1, wherein said shunt circuit (11) includes a diode (21) poled to pass the inductively induced current only and to block current supplied from the current supply (1) and connected to the primary (8).

* * * * *